US012790068B2

(12) United States Patent
Chung et al.

(10) Patent No.: US 12,790,068 B2
(45) Date of Patent: Nov. 10, 2026

(54) PACKING STRUCTURE WITH FOLDABLE BUFFER BOARD

(71) Applicant: Acer Incorporated, New Taipei City (TW)

(72) Inventors: Shu-Hsien Chung, New Taipei City (TW); Yi-Ping Ding, New Taipei City (TW)

(73) Assignee: Acer Incorporated, New Taipei City (TW)

( * ) Notice: Subject to any disclaimer, the term of this patent is extended or adjusted under 35 U.S.C. 154(b) by 0 days.

(21) Appl. No.: 19/262,058

(22) Filed: Jul. 7, 2025

(65) Prior Publication Data

US 2026/0015124 A1 Jan. 15, 2026

(30) Foreign Application Priority Data

Jul. 15, 2024 (TW) ..... 113126420

(51) Int. Cl.
*B65D 5/50* (2006.01)
*B65D 5/42* (2006.01)
*B65D 5/52* (2006.01)

(52) U.S. Cl.
CPC ..... *B65D 5/5038* (2013.01); *B65D 5/4212* (2013.01); *B65D 5/4266* (2013.01); *B65D 5/4295* (2013.01); *B65D 5/5213* (2013.01); *B65D 2585/6837* (2013.01)

(58) Field of Classification Search
CPC .... B65D 5/5038; B65D 5/5035; B65D 5/503; B65D 5/5028; B65D 5/5026; B65D 5/5213; B65D 5/5226; B65D 5/52; B65D 5/4295; B65D 5/4212; B65D 5/4266; B65D 5/56; B65D 25/10; B65D 25/24; B65D 2585/6837; B65D 2585/6835
USPC ..... 206/764, 756, 736, 45.28, 45.26, 45.25, 206/45.24, 45.21, 45.2; 220/23.86, 23.83, 220/528, 919, 918; 229/120.01
See application file for complete search history.

(56) References Cited

U.S. PATENT DOCUMENTS 1,313,906 A * 8/1919 Perez ..... B65D 5/5206 206/45.21
2,240,810 A * 5/1941 Snelling ..... B65D 5/528 206/736
3,164,350 A * 1/1965 Taub ..... A47F 5/114 211/133.1
4,020,946 A * 5/1977 Gardner ..... B65D 5/724 229/164
2004/0124120 A1* 7/2004 Egresitz ..... B65D 77/042 206/775
2004/0222127 A1* 11/2004 McLeod ..... B65D 5/4204 206/736

(Continued)

FOREIGN PATENT DOCUMENTS

TW 201408551 A * 3/2014 ..... B65D 81/05

*Primary Examiner* — Robert J Hicks
(74) *Attorney, Agent, or Firm* — JCIPRNET

(57) ABSTRACT

Presented is a packing structure, including an outer packing box, an inner packing box, and a buffer cardboard. The inner packing box and the buffer cardboard are disposed in the outer packing box, and the buffer cardboard is located between the inner packing box and the outer packing box. The buffer cardboard that has been taken out of the outer packing box is adapted to be folded to form a supporting base for placing an electronic device thereon.

12 Claims, 7 Drawing Sheets

(56) References Cited

U.S. PATENT DOCUMENTS

| | | | | |
|---|---|---|---|---|
| 2015/0034527 | A1* | 2/2015 | Tseng | B65D 5/5023 206/756 |
| 2024/0286789 | A1* | 8/2024 | Valencia | B65D 85/345 |

* cited by examiner

PACKING STRUCTURE WITH FOLDABLE BUFFER BOARD

CROSS-REFERENCE TO RELATED APPLICATION

This application claims the priority benefit of Taiwan application serial no. 113126420, filed on Jul. 15, 2024. The entirety of the above-mentioned patent application is hereby incorporated by reference herein and made a part of this specification.

BACKGROUND

Technical Field

The disclosure relates to a packing structure, and in particular to a packing structure applied to an electronic product.

Description of Related Art

After the assembly of an electronic product is completed, a packing structure is usually utilized to pack the electronic product to allow the electronic product to be protected by the packing structure to prevent damage. Taking a packing structure applied in a notebook computer as an example, the packing structure thereof is mostly formed by an outer packing box and an inner packing box. The notebook computer is packed in the inner packing box, and the inner packing box is packed in the outer packing box. Therefore, the notebook computer may be protected by the inner packing box and the outer packing box at the same time. In order to absorb an external impact force, a bubble bag, a bubble paper or a foam configured for buffering is usually disposed between the inner packing box and the outer packing box. Most of the foregoing buffer materials are thrown away after being taken out, and are not easy to decompose, which is incompatible with the sustainable development goals of environmental protection and resource reuse.

SUMMARY

The disclosure provides a packing structure that is compatible with the sustainable development goals of environmental protection and resource reuse.

The disclosure provides a packing structure that includes an outer packing box, an inner packing box, and a buffer cardboard. The inner packing box and buffer cardboard are disposed in the outer packing box, and the buffer cardboard is located between the inner packing box and the outer packing box. The buffer cardboard includes a main board, two first lateral boards, two second lateral boards, a first auxiliary board, and a second auxiliary board. The main board has a first side and a second side relative to the first side, and includes a first supporting board and a second supporting board foldably connected to the first supporting board. The two first lateral boards are foldably connected to the first supporting board respectively on the first side and the second side. The two second lateral boards are foldably connected to the second supporting board respectively on the first side and the second side. The first auxiliary board is detachably connected to the first lateral board and the second lateral board that are connected with the first side. The second auxiliary board is detachably connected to the first lateral board and the second lateral board that are connected with the second side. After the first auxiliary board and the second auxiliary board are disassembled, the second supporting board is folded relative to the first supporting board. The two first lateral boards are folded relative to the first supporting board to stand between the second supporting board and the first supporting board. The two second lateral boards are folded relative to the second supporting board to stand between the second supporting board and the first supporting board. The two first lateral boards are juxtaposed between the two second lateral boards.

Based on the above, in the packing structure of the disclosure, the buffer cardboard may absorb an impact force acting on the outer packing box to prevent the impact force from directly acting on the inner packing box and causing damage or harm to an electronic device. After the buffer cardboard has been taken out of the outer packing box, the buffer cardboard may be unfolded first. Next, a user may fold the buffer cardboard according to a folding line, a tearing line, or other folding reference features to form a supporting base for the electronic device to be placed. In other words, the buffer cardboard may not only be used to absorb an external impact force, but may also be reused as the supporting base for the electronic device to be placed, which is compatible with the sustainable development goals of environmental protection and resource reuse.

In order to make the features and advantages of the disclosure more comprehensible, the following examples are given and described in detail with the accompanying drawings as follows.

DESCRIPTION OF THE EMBODIMENTS

Figure 1:
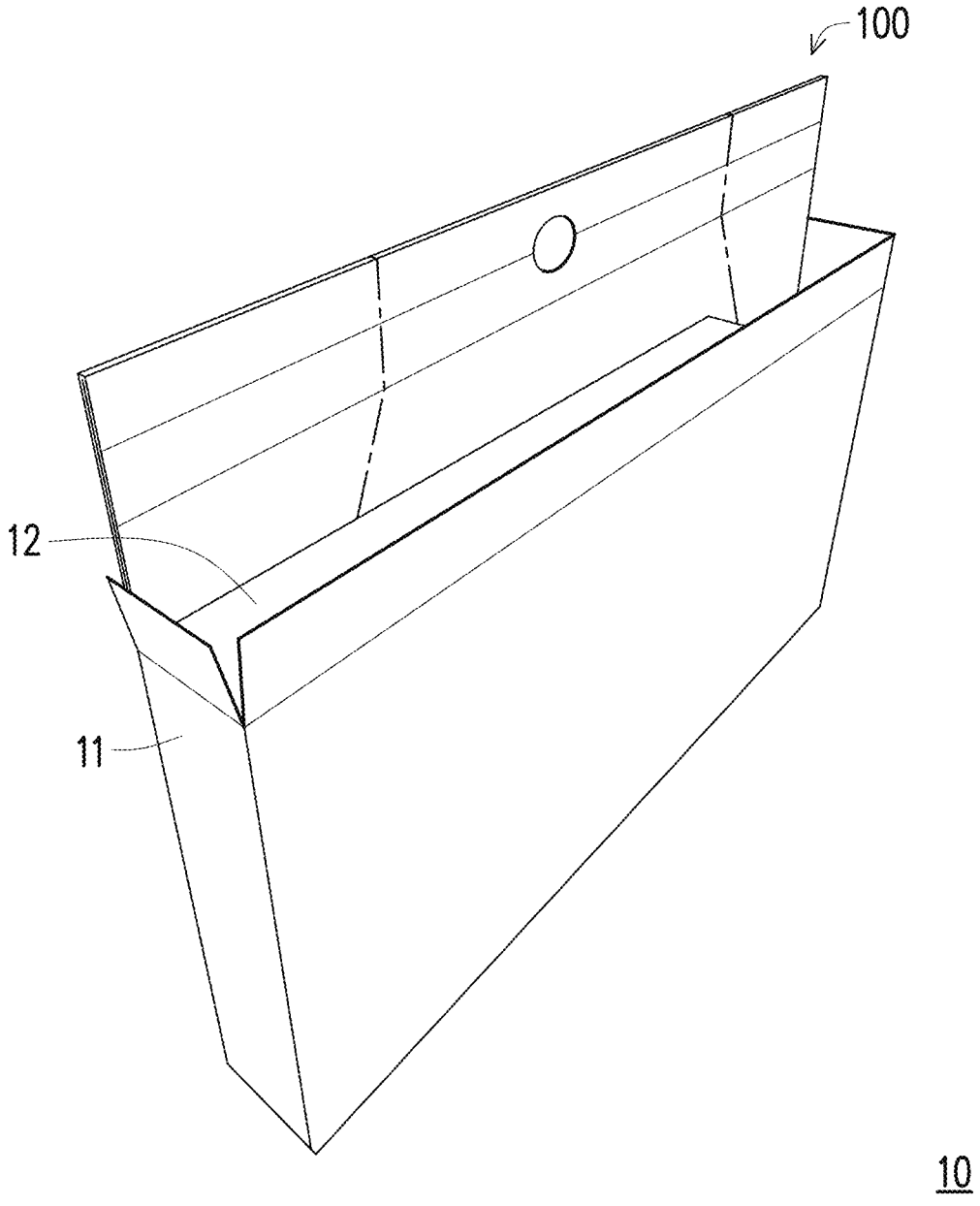
FIG. 1 is a schematic view of a packing structure according to an embodiment of the disclosure.

FIG. 1 is a schematic view of a packing structure according to an embodiment of the disclosure Please refer to FIG. 1. In the embodiment, a packing structure 10 is adaptable for packing and protecting an electronic device, such as a notebook computer, but the embodiment is not limited thereto. In detail, the packing structure 10 includes an outer packing box 11, an inner packing box 12, and a buffer cardboard 100. The electronic device is packed in the inner packing box 12, and the inner packing box 12 is removably disposed in the outer packing box 11. Therefore, the electronic device may be protected by the inner packing box 12 and the outer packing box 11 at the same time to prevent damage during transportation.

The outer packing box 11, the inner packing box 12, and the buffer cardboard 100 may all be made of corrugated paper. The buffer cardboard 100 is removably disposed in the outer packing box 11 and located between the inner packing box 12 and the outer packing box 11. Furthermore, the buffer cardboard 100 may absorb an impact force acting on the outer packing box 11 to prevent the impact force from directly acting on the inner packing box 12 and causing damage or harm to the electronic device. For example, in order to improve a buffering effect, the buffer cardboard 100 may be folded first to increase a thickness thereof, and then the buffer cardboard 100 that has been folded may be placed between the inner packing box 12 and the outer packing box 11.

Figure 2A:
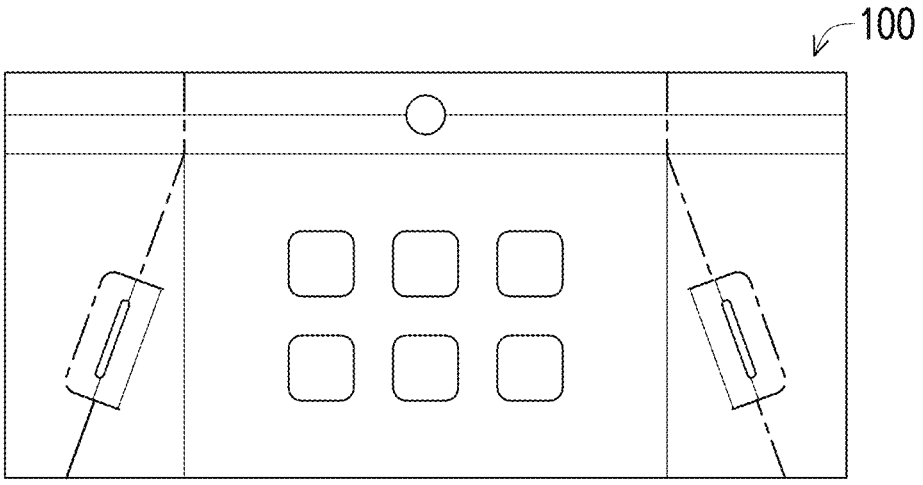
FIG. 2A is a schematic view of the buffer cardboard of FIG. 1 that has been taken out of the outer packing box.
Figure 2B:
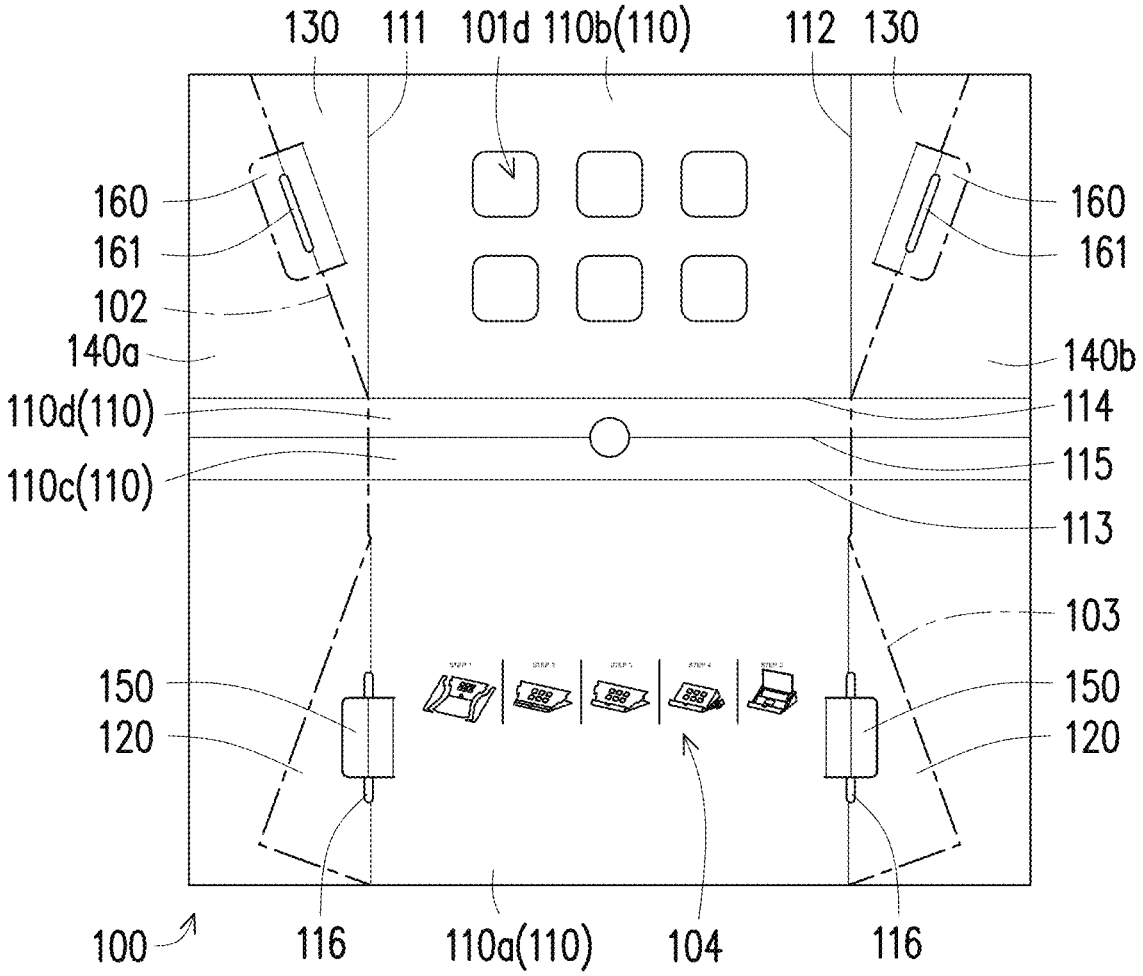
FIG. 2B is an unfolding schematic view of the buffer cardboard of FIG. 2A.
Figure 3A:
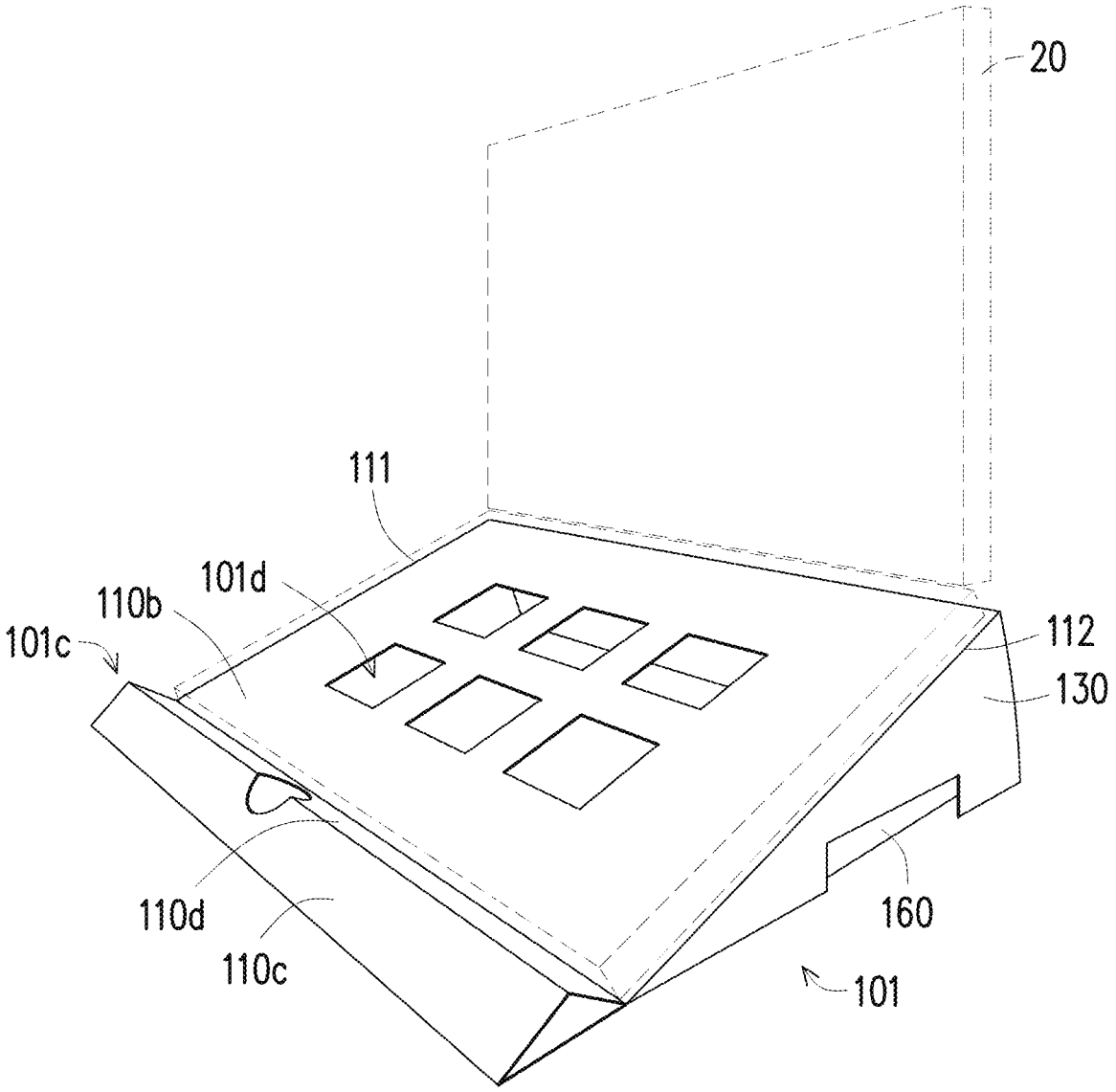
FIG. 3A is a schematic view of the buffer cardboard of FIG. 2B that has been folded to form a supporting base.
Figure 3B:
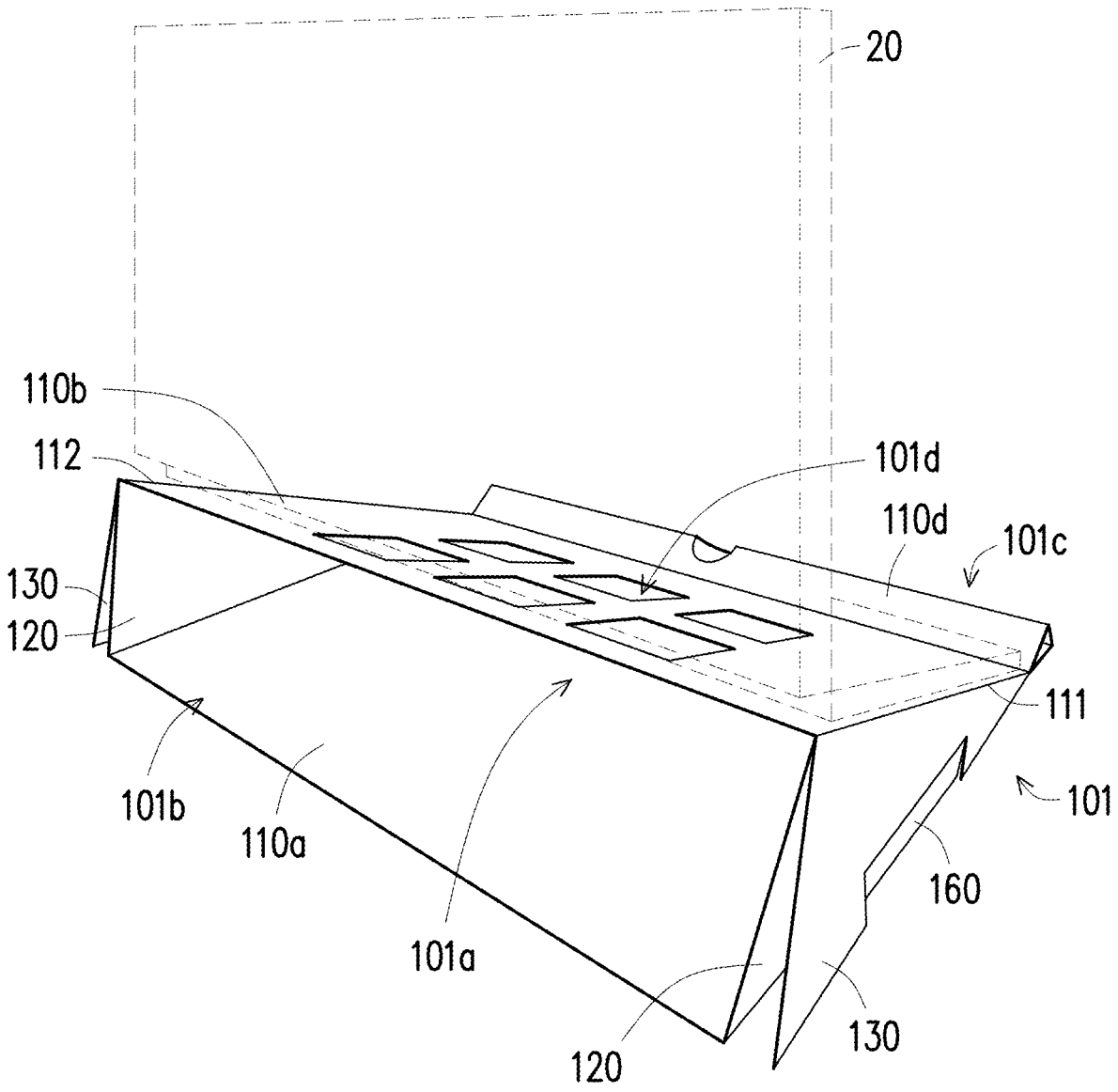
FIG. 3B is a schematic view of FIG. 3A from another perspective.

FIG. 2A is a schematic view of the buffer cardboard of FIG. 1 that has been taken out of the outer packing box. FIG. 2B is an unfolding schematic view of the buffer cardboard of FIG. 2A. FIG. 3A is a schematic view of the buffer cardboard of FIG. 2B that has been folded to form a supporting base. FIG. 3B is a schematic view of FIG. 3A from another perspective. As shown in FIG. 1, FIG. 2A, and FIG. 2B, after the buffer cardboard 100 has been taken out of the outer packing box 11, the buffer cardboard 100 may be unfolded first. Next, as shown in FIG. 2B, FIG. 3A, and FIG. 3B, a user may fold the buffer cardboard 100 according to a folding line, a tearing line, or other folding reference features to form a supporting base 101 for an electronic device 20 to be placed. In other words, the buffer cardboard 100 may not only be used to absorb an external impact force, but may also be reused as the supporting base 101 for the electronic device 20 to be placed, which is compatible with the sustainable development goals of environmental protection and resource reuse.

As shown in FIG. 3A and FIG. 3B, the electronic device 20 placed on the supporting base 101 may be tilted relative to a work plane to offer the user to obtain a better operating angle or viewing angle that improves operation comfort. On the other hand, the supporting base 101 may be used as a heat dissipating supporting base. The supporting base 101 is a hollow structure, and has a heat dissipating space 101*a* communicating with outside. Furthermore, the supporting base 101 has a relatively high side and a low side. The high side has a heat dissipating opening 101*b* communicating with the heat dissipating space 101*a*, and the low side has a limiting protrusion 101*c* configured for stopping the electronic device 20 to avoid the electronic device 20 sliding off the supporting base 101. In addition, a supporting surface on which the electronic device 20 is placed has one or more heat dissipating holes 101*d*. The heat dissipating hole 101*d* is communicating with the heat dissipating space 101*a* and located between the high side and the low side.

For example, the heat dissipating opening 101*b* may be used as an air inlet for external cold air to enter the heat dissipating space 101*a*. Correspondingly, the heat dissipating space 101*a* may be used as an air inlet space, and the heat dissipating hole 101*d* may be used as an air outlet for cold air to discharge from the heat dissipating space 101*a* to outside. Therefore, cold air may enter the heat dissipating space 101*a* through the heat dissipating opening 101*b*, and then be blown from the heat dissipating space 101*a* to the electronic device 20 through the heat dissipating hole 101*d* to provide the cold air needed for the electronic device 20 to dissipate heat. In other words, the supporting base 101 may provide a heat dissipating airflow channel for the electronic device placed thereon to avoid the electronic device 20 malfunctioning or declining in performance due to overheating.

Please refer to FIG. 2B. In the embodiment, the buffer cardboard 100 includes a main board 110, two first lateral boards 120, two second lateral boards 130, a first auxiliary board 140*a*, and a second auxiliary board 140*b*. The main board 110 may be a rectangular board. The main board 110 has a first side 111 and a second side 112 relative to the first side 111, and the first side 111 and the second side 112 may be two long sides in the rectangular board that are parallel to each other.

The two first lateral boards 120 are symmetrically disposed and respectively connected to the first side 111 and the second side 112. The two second lateral boards 130 are symmetrically disposed and respectively connected the first side 111 and the second side 112. In addition, the first auxiliary board 140*a* and the second auxiliary board 140*b* are symmetrically disposed. The first auxiliary board 140*a* is connected to the first lateral board 120 and the second lateral board 130 that are connected with the first side 111, and the second auxiliary board 140*b* is connected to the first lateral board 120 and the second lateral board 130 that are connected with the second side 112.

Please refer to FIG. 2B. The main board 110 includes a first supporting board 110*a*, a second supporting board 110*b*, a first folding connecting board 110*c*, and a second folding connecting board 110*d*. The first folding connecting board 110*c* and the second folding connecting board 110*d* are located between the first supporting board 110*a* and the second supporting board 110*b*, and the first folding connecting board 110*c* is connected between the first supporting board 110*a* and the second folding connecting board 110*d*. In addition, the second folding connecting board 110*d* is connected between the first folding connecting board 110*c* and the second supporting board 110*b*.

For example, the first supporting board 110*a*, the first folding connecting board 110*c*, the second folding connecting board 110*d*, and the second supporting board 110*b* may be four rectangular boards that are sequentially connected. An area of the first supporting board 110*a* may be larger than an area of the second supporting board 110*b*, and the area of the second supporting board 110*b* may be larger than an area of the first folding connecting board 110*c* and an area of the second folding connecting board 110*d*. In addition, the area of the first folding connecting board 110*c* may be equal to the area of the second folding connecting board 110*d*, and a sum of the area of the second supporting board 110*b*, the area of the first folding connecting board 110*c*, and the area of the second folding connecting board 110*d* may be equal to the area of the first supporting board 110*a*.

Please refer to FIG. 2B. There is a first folding line 113 between the first folding connecting board 110*c* and the first supporting board 110*a* to allow the first folding connecting board 110*c* to be folded along the first folding line 113 relative to the first folding connecting board 110*c*. There is a second folding line 114 between the second folding connecting board 110*d* and the second supporting board 110*b* to allow the second supporting board 110*b* to be folded along the second folding line 114 relative to the second folding connecting board 110*d*. In addition, there is a third folding line 115 between the first folding connecting board 110*c* and the second folding connecting board 110*d* to allow the second folding connecting board 110*d* to be folded along the third folding line 115 relative to the first folding connecting board 110*c*. That is to say, the second supporting board 110*b* is foldably connected to the first supporting board 110*a* through the second folding connecting board 110*d* and the first folding connecting board 110*c*.

In detail, the third folding line 115 is located between the first folding line 113 and the second folding line 114, and is parallel to the first folding line 113 and the second folding line 114. On the other hand, the first folding line 113, the second folding line 114, and the third folding line 115 are all perpendicularly connected to the first side 111 and the second side 112, and are arranged between the first side 111 and the second side 112.

Please refer to FIG. 2B. The two first lateral boards 120 are connected to the first supporting board 110*a* respectively on the first side 111 and the second side 112. There is a folding line that overlaps on the first side 111 between one of the two first lateral boards 120 and the first supporting board 110*a*, and there is a folding line that overlaps on the second side 112 between another one of the two first lateral boards 120 and the first supporting board 110*a*. Therefore, the two first lateral boards 120 may be folded respectively along the first side 111 and the second side 112 relative to the first supporting board 110*a*.

On the other hand, the two second lateral boards 130 are connected to the second supporting board 110*b* respectively on the first side 111 and the second side 112. There is a folding line that overlaps on the first side 111 between one of the two second lateral boards 130 and the second supporting board 110*b*, and there is a folding line that overlaps on the second side 112 between another one of the two second lateral boards 130 and the second supporting board 110*b*. Therefore, the two second lateral boards 130 may be folded respectively along the first side 111 and the second side 112 relative to the second supporting board 110*b*.

Please refer to FIG. 2B. The first lateral board 120 that is connected with the first side 111, the first supporting board 110*a*, and the first lateral board 120 that is connected with the second side 112 are sequentially arranged between the first auxiliary board 140*a* and the second auxiliary board 140*b*. Correspondingly, the second lateral board 130 that is connected with the first side 111, the second supporting board 110*b*, and the second lateral board 130 that is connected with the second side 112 are sequentially arranged between the first auxiliary board 140*a* and the second auxiliary board 140*b*.

On the other hand, the first side 111 of the main board 110 has a section that is not connected with the first lateral board 120 and the second lateral board 130, and the first auxiliary board 140*a* is connected to the section to be connected to the first folding connecting board 110*c*, the second folding connecting board 110*d*, and the first supporting board 110*a*. Correspondingly, the second side 112 of the main board 110 has a section that is not connected with the first lateral board 120 and the second lateral board 130, and the second auxiliary board 140*b* is connected to the section to be connected to the first folding connecting board 110*c*, the second folding connecting board 110*d*, and the first supporting board 110*a*.

Please refer to FIG. 2B. The buffer cardboard 100 has a first tearing line 102 and a second tearing line 103 relative to the first tearing line 102, and the first tearing line 102 and the second tearing line 103 are symmetrically disposed. The first auxiliary board 140*a* is connected through the first tearing line 102 to the first lateral board 120 that is connected with the first side 111, the second lateral board 130 that is connected with the first side 111, and the section in the first side 111 that is not connected with the first lateral board 120 and the second lateral board 130. Correspondingly, the second auxiliary board 140*b* is connected through the second tearing line 103 to the first lateral board 120 that is connected with the second side 112, the second lateral board 130 that is connected with the second side 112, and the section in the second side 112 that is not connected with the first lateral board 120 and the second lateral board 130.

Furthermore, the first tearing line 102 may include multiple holes arranged along a predetermined cutting line to facilitate detaching the first auxiliary board 140*a* along the first tearing line 102 from the first lateral board 120 that is connected with the first side 111 and the second lateral board 130 that is connected with the first side 111. Correspondingly, the second tearing line 103 may include multiple holes arranged along a predetermined cutting line to facilitate detaching the second auxiliary board 140*b* along the second tearing line 103 from the first lateral board 120 that is connected with the second side 112 and the second lateral board 130 that is connected with the second side 112.

FIG. 4A to FIG. 4D are process schematic views of folding a buffer cardboard to form a supporting base. First, please refer to FIG. 2B and FIG. 4A. The first supporting board 110*a* has a folding procedure reference diagram 104 of the buffer cardboard 100 printed between the first side 111 and the second side 112 to facilitate the user to refer to the folding procedure reference diagram 104 to fold and assemble the supporting base 101 shown in FIG. 3A and FIG. 3B. In detail, before the buffer cardboard 100 is folded, the first auxiliary board 140*a* and the second auxiliary board 140*b* must be disassembled first respectively along the first tearing line 102 and the second tearing line 103.

Figure 4A:
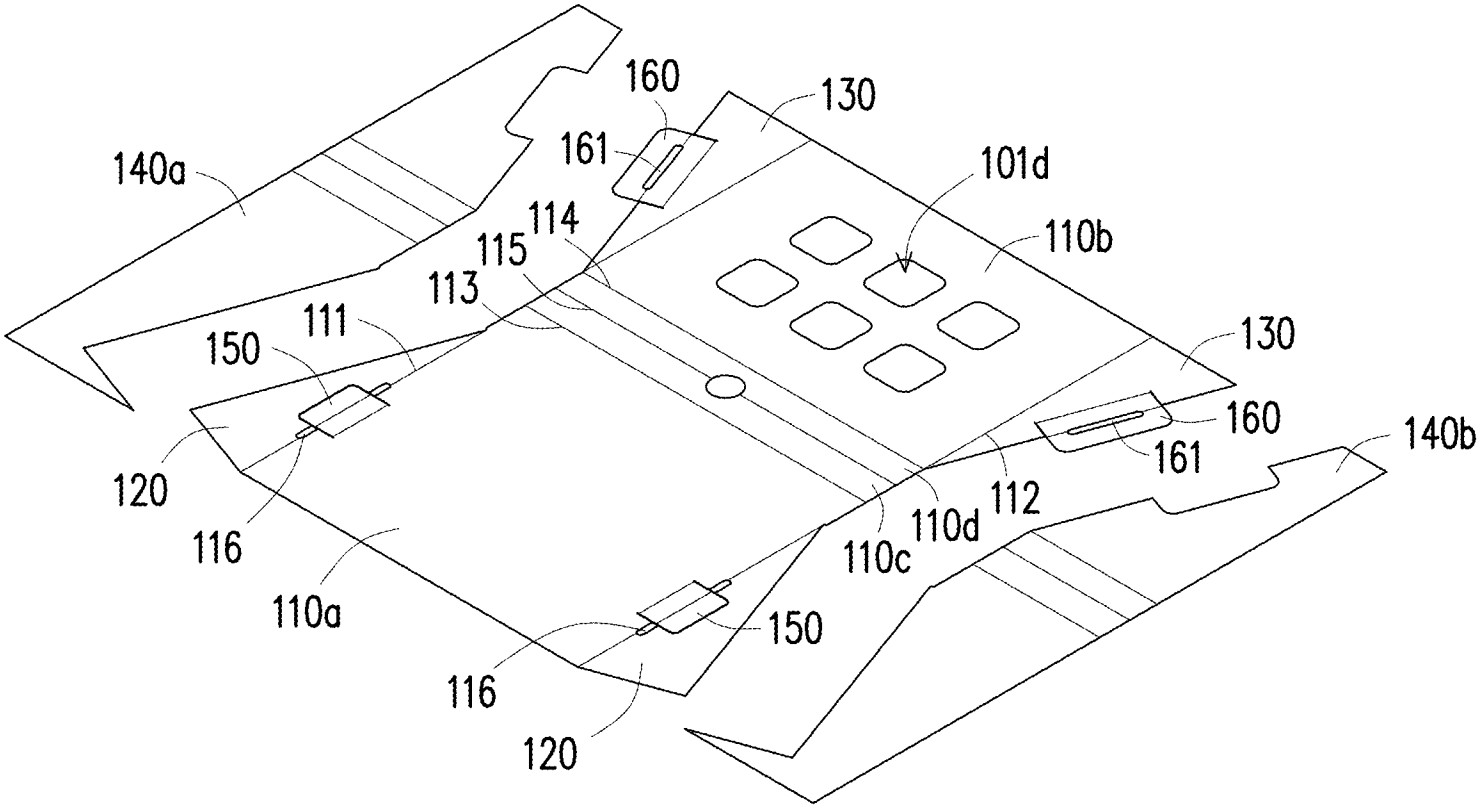
FIG. 4A to FIG. 4D are process schematic views of folding a buffer cardboard to form a supporting base.
Figure 4B:
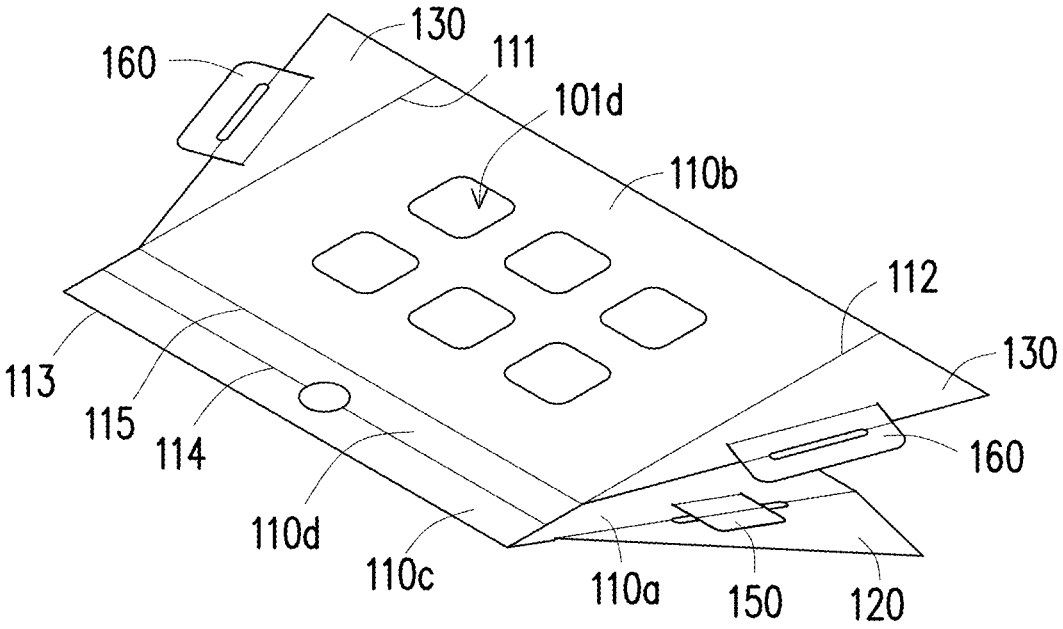

Next, please refer to FIG. 2B and FIG. 4B. The second supporting board 110*b* is allowed to be folded along the first folding line 113 relative to the first supporting board 110*a*, and an angle between the second supporting board 110*b* and the first supporting board 110*a* is allowed to be acute to let the second supporting board 110*b* to be inclined to the first supporting board 110*a*. Next, please refer to FIG. 2B, FIG. 4B, and FIG. 4C. The second folding connecting board 110*d* is allowed to be folded along the second folding line 114 relative to the second supporting board 110*b*, the first folding connecting board 110*c* is allowed to be folded along the third folding line 115 relative to the second folding connecting board 110*d*, and the first folding connecting board 110*c* is allowed to be folded along the first folding line 113 relative to the first supporting board 110*a* to allow the first folding connecting board 110*c* and the second folding connecting board 110*d* that are relatively folded to form a limiting protrusion 101*c*. For example, a cross-sectional profile of the limiting protrusion 101*c* may be a triangular profile.

Figure 4C:
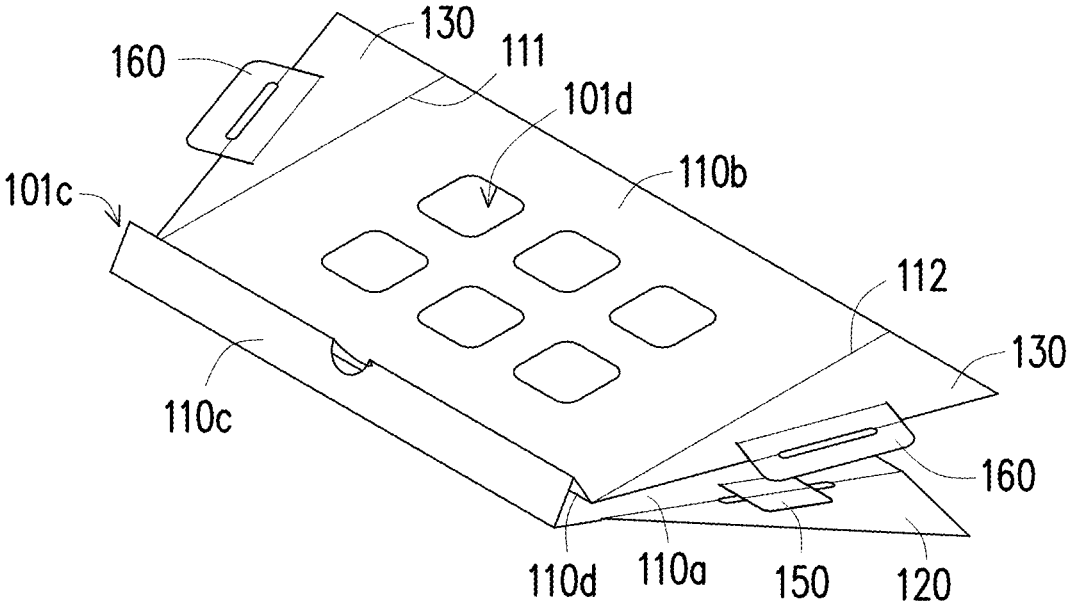
Figure 4D:
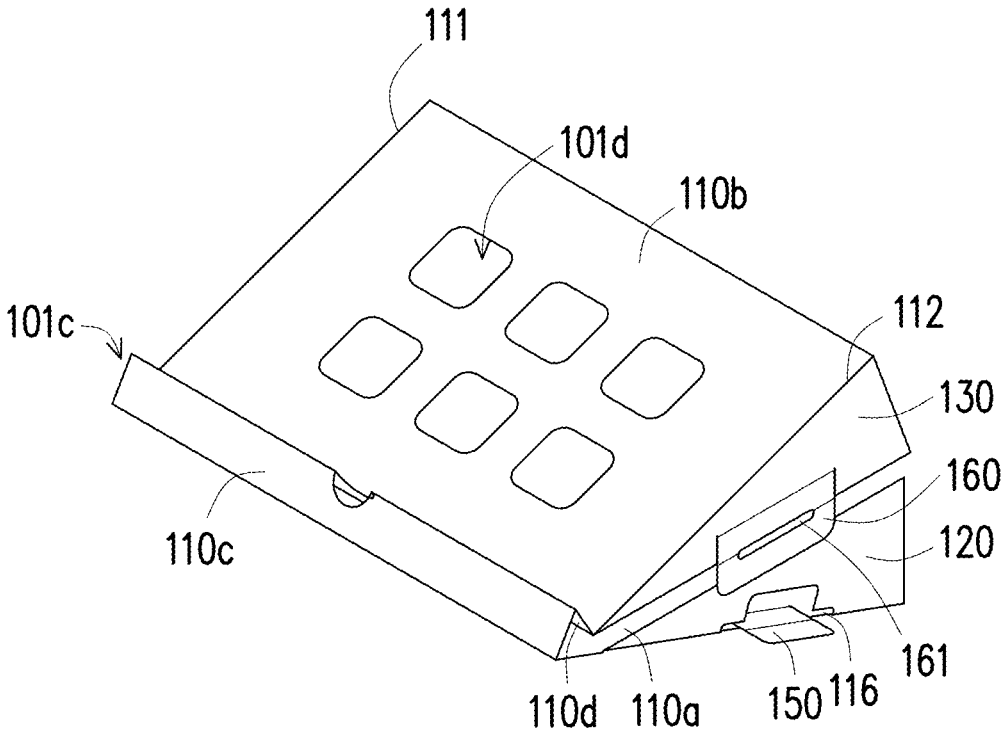

Next, please refer to FIG. 2B, FIG. 4C, and FIG. 4D. The two first lateral boards 120 are allowed to be folded relative to the first supporting board 110*a* toward the second supporting board 110*b*, and a folding angle is approximately 90 degrees. Then, the two second lateral boards 130 are allowed to be folded relative to the second supporting board 110*b* toward the first supporting board 110*a*, and a folding angle is approximately 90 degrees. After the foregoing folding procedure, the two first lateral boards 120 are juxtaposed between the two second lateral boards 130, and one of the second lateral boards 130, one of the first lateral boards 120, another one of the first lateral boards 120, and another one of the second lateral boards 130 sequentially stand between the second supporting board 110*b* and the first supporting board 110*a* to support the second supporting board 110*b* as shown in FIG. 3B.

As shown in FIG. 2B, FIG. 3B, and FIG. 4D, each of the first lateral boards 120 and each of the second lateral boards 130 may be a triangular board, preferably a right triangular board. Furthermore, each of the first lateral boards 120 that stands between the second supporting board 110*b* and the first supporting board 110*a* contacts the second supporting board 110*b*, and contacts opposite sides (that is, the first side 111 and the second side 112) of the second supporting board 110*b* at a right angle with an adjacent side or an opposite side to allow the second supporting board 110*b* to be inclined to the first supporting board 110*a*.

On the other hand, each of the second lateral boards 130 is connected to the second supporting board 110*b* at a right angle with an adjacent side or an opposite side to allow each of the second lateral boards 130 that has been folded to face the work plane with a hypotenuse, and the two first lateral boards 120 and the two second lateral boards 130 jointly support the second supporting board 110*b* to allow the second supporting board 110*b* to be inclined to the first supporting board 110*a*.

As shown in FIG. 2B, FIG. 3B and FIG. 4D, the buffer cardboard 100 further includes two first fasteners 150 and two second fasteners 160. The two first fasteners 150 are symmetrically disposed, and are foldably connected to the first supporting board 110*a* respectively on the first side 111 and the second side 112. In addition, the two second fasteners 160 are symmetrically disposed, and are foldably connected to the two second lateral boards 130 respectively corresponding to the two first fasteners 150.

Furthermore, the first supporting board 110*a* is individually provided with a first lock hole 116 on the first side 111 and the second side 112, and each of the second fasteners 160 has a second lock hole 161. The two first lock holes 116 are disposed corresponding to the two second fasteners 160, and the two first fasteners 150 respectively partially overlap on the two first lock holes 116. In addition, the two second lock holes 161 are disposed corresponding to the two first fasteners 150.

After the two first lateral boards 120 are folded relative to the first supporting board 110*a* toward the second supporting board 110*b*, and the two second lateral boards 130 are folded relative to the second supporting board 110*b* toward the first supporting board 110*a*, the two first fasteners 150 are respectively separated on the two first lock holes 116. Next, the two second fasteners 160 are folded respectively relative to the two second lateral boards 130 and inserted into the two first lock holes 116. Then, the two first fasteners 150 are folded respectively relative to the first supporting board 110*a* and inserted into the two second lock holes 161 to allow the first lateral board 120 and the second lateral board 130 that are connected with the first side 111 to be tightly joined, and to allow the first lateral board 120 and the second lateral board that are connected with the second side 112 to be tightly joined. At this point, the assembly of a folding group of the supporting base 101 is roughly completed.

As shown in FIG. 3A and FIG. 3B, the second supporting board 110*b* is supported by the two first lateral boards 120 and the two second lateral boards 130 and is inclined to the first supporting board 110*a*, and the second supporting board 110*b*, the two first lateral boards 120 and the first supporting board 110*a* surround to form the heat dissipating space 101*a* and the heat dissipating opening 101*b* communicating with the heat dissipating space 101*a*. In addition, the second supporting board 110*b* may provide an inclined supporting plane for the electronic device and the heat dissipating hole 101*d* that the second supporting board 110*b* is communicating with the heat dissipating space 101*a*.

In an embodiment, the first auxiliary board 140*a* and the second auxiliary board 140*b* that have been disassembled may be folded and inserted into the heat dissipating space 101*a* to jointly support the second supporting board 110*b* with the two first lateral boards 120 and the two second lateral boards 130.

In summary, in the packing structure of the disclosure, the buffer cardboard may absorb an impact force acting on the outer packing box to prevent the impact force from directly acting on the inner packing box and causing damage or harm to the electronic device. After the buffer cardboard has been taken out of the outer packing box, the buffer cardboard may be unfolded first. Next, the user may fold the buffer cardboard according to a folding line, a tearing line, or other folding reference features to form the supporting base for the electronic device to be placed. In other words, the buffer cardboard may not only be configured to absorb the external impact force, but may also be reused as the supporting base for the electronic device to be placed, which is consistent with the sustainable development goals of environmental protection and resource reuse.

Furthermore, the electronic device placed on the supporting base may be tilted relative to the work plane to provide the user with a better operating angle or viewing angle that improves operation comfort. In addition, the supporting base may provide the heat dissipating airflow channel for the electronic device placed thereon to avoid the electronic device malfunctioning or declining in performance due to overheating.

Although the disclosure has been disclosed in the above embodiments, the embodiments are not intended to limit the disclosure. Persons skilled in the art may make some changes and modifications without departing from the spirit and scope of the disclosure. Therefore, the protection scope of the disclosure shall be defined by the appended claims.

What is claimed is:

1. A packing structure, comprising:

an outer packing box;

an inner packing box, disposed in the outer packing box; and a buffer cardboard, disposed in the outer packing box, and located between the inner packing box and the outer packing box, wherein the buffer cardboard comprises:

a main board, having a first side and a second side relative to the first side, and comprising a first supporting board and a second supporting board foldably connected to the first supporting board;

two first lateral boards, foldably connected to the first supporting board respectively on the first side and the second side;

two second lateral boards, foldably connected to the second supporting board respectively on the first side and the second side;

a first auxiliary board, detachably connected to the first lateral board and the second lateral board that are connected with the first side; and a second auxiliary board, detachably connected to the first lateral board and the second lateral board that are connected with the second side, wherein after the first auxiliary board and the second auxiliary board are disassembled, the second supporting board is folded relative to the first supporting board, the two first lateral boards are folded relative to the first supporting board to stand between the second supporting board and the first supporting board, the two second lateral boards are folded relative to the second supporting board to stand between the second supporting board and the first supporting board, and the two first lateral boards are juxtaposed between the two second lateral boards.

2. The packing structure according to claim 1, wherein the buffer cardboard has a first tearing line and a second tearing line relative to the first tearing line, the first auxiliary board is connected through the first tearing line to the first lateral board and the second lateral board that are connected with the first side, and the second auxiliary board is connected through the second tearing line to the first lateral board and the second lateral board that are connected with the second side.

3. The packing structure according to claim 1, wherein the two first lateral boards that stand between the second supporting board and the first supporting board contact the second supporting board.

4. The packing structure according to claim 1, wherein the two first lateral boards that stand between the second supporting board and the first supporting board respectively contact the first side and the second side.

5. The packing structure according to claim 1, wherein the second supporting board is supported by the two first lateral boards and the two second lateral boards and inclined to the first supporting board, and the second supporting board, the two first lateral boards and the first supporting board surround to form a heat dissipating space and a heat dissipating opening communicating with the heat dissipating space.

6. The packing structure according to claim 5, wherein the second supporting board has a heat dissipating hole, and the heat dissipating hole is communicating with the heat dissipating space.

7. The packing structure according to claim 1, wherein the buffer cardboard further comprises two first fasteners and two second fasteners, the two first fasteners are foldably connected to the first supporting board respectively on the first side and the second side, and the two second fasteners are foldably connected to the two second lateral boards respectively, the first supporting board is individually provided with a first lock hole on the first side and the second side, and each of the second fasteners has a second lock hole, after the first auxiliary board and the second auxiliary board are disassembled, the second supporting board is folded relative to the first supporting board, and the two first lateral boards are folded relative to the first supporting board to stand between the second supporting board and the first supporting board, the two second lateral boards are folded relative to the second supporting board to stand between the second supporting board and the first supporting board, the two second fasteners are folded respectively relative to the two second lateral boards and inserted into the two first lock holes, and the two first fasteners are folded respectively relative to the first supporting board and inserted into the two second lock holes.

8. The packing structure according to claim 7, wherein the two first fasteners respectively partially overlap on the two first lock holes.

9. The packing structure according to claim 1, wherein the two first lateral boards and the two second lateral boards are a plurality of triangular boards.

10. The packing structure according to claim 1, wherein the buffer cardboard further comprises a first folding connecting board and a second folding connecting board that are located between the first supporting board and the second supporting board, the first folding connecting board is foldably connected between the first supporting board and the second folding connecting board, and the second folding connecting board is foldably connected between the first folding connecting board and the second supporting board, after the first auxiliary board and the second auxiliary board are disassembled, the second folding connecting board is folded relative to the second supporting board, the first folding connecting board is folded relative to the second folding connecting board, the first folding connecting board is folded relative to the first supporting board, and a limiting protrusion is formed by the first folding connecting board and the second folding connecting board that have been relatively folded.

11. The packing structure according to claim 10, wherein there is a first folding line between the first folding connecting board and the first supporting board, there is a second folding line between the second folding connecting board and the second supporting board, and there is a third folding line between the first folding connecting board and the second folding connecting board, wherein the third folding line is located between the first folding line and the second folding line, and is parallel to the first folding line and the second folding line.

12. The packing structure according to claim 1, wherein the first supporting board has a folding procedure reference diagram printed between the first side and the second side.

* * * * *